US008857385B2

(12) United States Patent
Beyer et al.

(10) Patent No.: US 8,857,385 B2
(45) Date of Patent: Oct. 14, 2014

(54) INTEGRATED EXHAUST CYLINDER HEAD

(75) Inventors: Theodore Beyer, Canton, MI (US); John Christopher Riegger, Ann Arbor, MI (US); Eric Dummer, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 203 days.

(21) Appl. No.: 13/159,318

(22) Filed: Jun. 13, 2011

(65) Prior Publication Data

US 2012/0312257 A1 Dec. 13, 2012

(51) Int. Cl.

| | |
|---|---|
| ***F02F 1/36*** | (2006.01) |
| ***F02F 1/40*** | (2006.01) |
| ***F01P 11/02*** | (2006.01) |
| ***F02F 1/24*** | (2006.01) |

(52) U.S. Cl.

CPC ..... *F02F 1/40* (2013.01); *F01P 2025/44* (2013.01); *F01P 11/0285* (2013.01); *F02F 1/243* (2013.01)

USPC ..... 123/41.82 R; 123/41.21; 123/41.24; 123/41.27

(58) Field of Classification Search

USPC ..... 123/41.82 R, 41.21, 41.24, 41.27

See application file for complete search history.

(56) References Cited

U.S. PATENT DOCUMENTS

| | | | | |
|---|---|---|---|---|
| 1,683,268 | A | 9/1928 | Streeter | |
| 1,704,951 | A * | 3/1929 | Rudkin | 123/25 N |
| 1,712,464 | A | 5/1929 | Woolson | |
| 2,035,611 | A | 3/1936 | Lee | |
| 3,448,729 | A | 6/1969 | Parsons | |
| 4,473,045 | A * | 9/1984 | Bolander et al. | 123/198 F |
| 4,550,694 | A | 11/1985 | Evans | |
| 4,570,579 | A | 2/1986 | Hirano | |
| 4,622,925 | A * | 11/1986 | Kubozuka | 123/41.25 |
| 4,648,357 | A * | 3/1987 | Hayashi | 123/41.27 |
| 4,658,764 | A * | 4/1987 | Miura et al. | 123/41.12 |
| 4,658,765 | A * | 4/1987 | Hayashi | 123/41.21 |
| 4,664,072 | A | 5/1987 | Shimonosono | |
| 4,722,304 | A * | 2/1988 | Hirano | 123/41.21 |
| 5,031,579 | A | 7/1991 | Evans | |
| 6,216,646 | B1 * | 4/2001 | Smith et al. | 123/41.54 |
| 6,470,867 | B2 | 10/2002 | Akiwa et al. | |
| 6,582,263 | B1 | 6/2003 | Jaeger et al. | |
| 6,810,838 | B1 * | 11/2004 | Hellman | 123/41.28 |
| 7,367,294 | B2 | 5/2008 | Rozario et al. | |
| 7,748,211 | B2 | 7/2010 | Norris et al. | |
| 7,757,654 | B2 | 7/2010 | Nagafuchi et al. | |
| 2008/0308050 | A1 * | 12/2008 | Kuhlbach et al. | 123/41.82 R |
| 2010/0011756 | A1 | 1/2010 | Nagafuchi | |
| 2010/0224144 | A1 * | 9/2010 | Lopez-Crevillen et al. | 123/41.82 R |
| 2010/0242869 | A1 * | 9/2010 | Knollmayr | 123/41.82 R |

* cited by examiner

*Primary Examiner* — Marguerite McMahon
*Assistant Examiner* — James Kim
(74) *Attorney, Agent, or Firm* — Greg Brown; Alleman Hall McCoy Russell & Tuttle LLP

(57) ABSTRACT

A cylinder head including an integrated exhaust manifold (IEM cylinder head) is coupled to a cylinder block of an engine. The IEM cylinder head comprises an exhaust collector coupled to cylinder exhaust valves, an exhaust port coupled to the exhaust collector, and a coolant jacket for cooling the cylinder head. An upper wall of the cylinder head at a region above the exhaust collector and proximal to the exhaust port may include a degas valve and a temperature sensor. The degas valve may be coupled at a top most dome portion of an upper coolant core of the coolant jacket to direct accumulated steam and/or gas out of the upper coolant core to a degas bottle.

16 Claims, 7 Drawing Sheets

INTEGRATED EXHAUST CYLINDER HEAD

BACKGROUND AND SUMMARY

Exhaust manifolds for internal combustion engines may be exposed to high thermal loads. Exhaust manifolds that are integrated into cylinder heads (IEM cylinder heads) may experience particularly high thermal loading due to the heat transfer characteristics of the integrated design. For example, IEM cylinder heads may channel exhaust to a collector and a single exhaust port, which experiences a high thermal load during operation of the vehicle.

Thermal loading of an IEM and neighboring components can be reduced by incorporating coolant jackets into the cylinder head. The coolant jackets with, a coolant core formed therein, can reduce the thermal stresses on the cylinder head caused by heat generated during engine operation. For example, a cylinder head having an integrated exhaust manifold is disclosed in U.S. Pat. No. 7,367,294. Upper and lower coolant jackets encompass a major portion of the cylinder head to remove heat from the cylinder head via heat exchange with a circulated liquid coolant.

However, the inventors herein have recognized issues with the above described approach. For example, during some conditions, steam may accumulate in portions of the coolant passages, such as in portions of the coolant chamber positioned vertically at a top of the passages in the IEM and proximate to the exhaust port. Accumulation of steam and/or other gases causes the liquid coolant to lose contact with at least a top wall of the coolant jacket. Under such conditions, the temperature of cylinder head can increase in a region of the cylinder head proximal the accumulated steam, particularly in a region proximal to the exhaust collector and the exhaust port. As a result, the cylinder head and/or other cylinder components may thermally degrade. Further, exhaust gases may be insufficiently cooled and downstream engine or vehicle components, such as a turbocharger and/or an emission control system, may also thermally degrade.

As such, various example systems and approaches to address the above issues are described herein. In one example, an engine cooling system comprises a cylinder head including an integrated exhaust manifold that directs exhaust gases to an exhaust port; a coolant passage surrounding the exhaust manifold and having a coolant jacket above the exhaust port; and a degas port positioned along the top side of the coolant jacket, the degas port fluidically coupled to the coolant passage at an inlet of the degas port. The degas port may be further coupled to a degas bottle at an outlet of the degas port. The degas bottle may permit pressure relief via a pressure release valve and return of liquid coolant to a coolant passage of a radiator. Furthermore, a temperature sensor may be included in the coolant jacket at a position near exhaust collector and/or the exhaust port to communicate a temperature signal to a controller of the vehicle. If the temperature signal is greater than a predetermined threshold, an overheating indication may be provided and/or corrective action may be taken by the engine control system.

In this way, the cooling system may provide improved engine overheating protection. For example, steam accumulated at the top of the coolant chamber can be vented from the coolant chamber to the degas bottle. As a result, the liquid coolant may maintain contact with the coolant jacket wall, and continue heat exchange in order to decrease thermal stress on the cylinder head by generating a convective coolant circuit. Thus, the degas port along the top side of the coolant jacket may decrease the likelihood of thermal degradation of the cylinder head and cool exhaust gas to decrease the likelihood of thermal degradation on downstream components, such as the turbocharger, the emission control system, etc. Further, the temperature sensor may provide an improved indication of over-temperature conditions in the exhaust system. Thus, performance and life of the engine, turbocharger, and emission control system can be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-10 are drawn approximately to scale.

DETAILED DESCRIPTION

Figure 1:
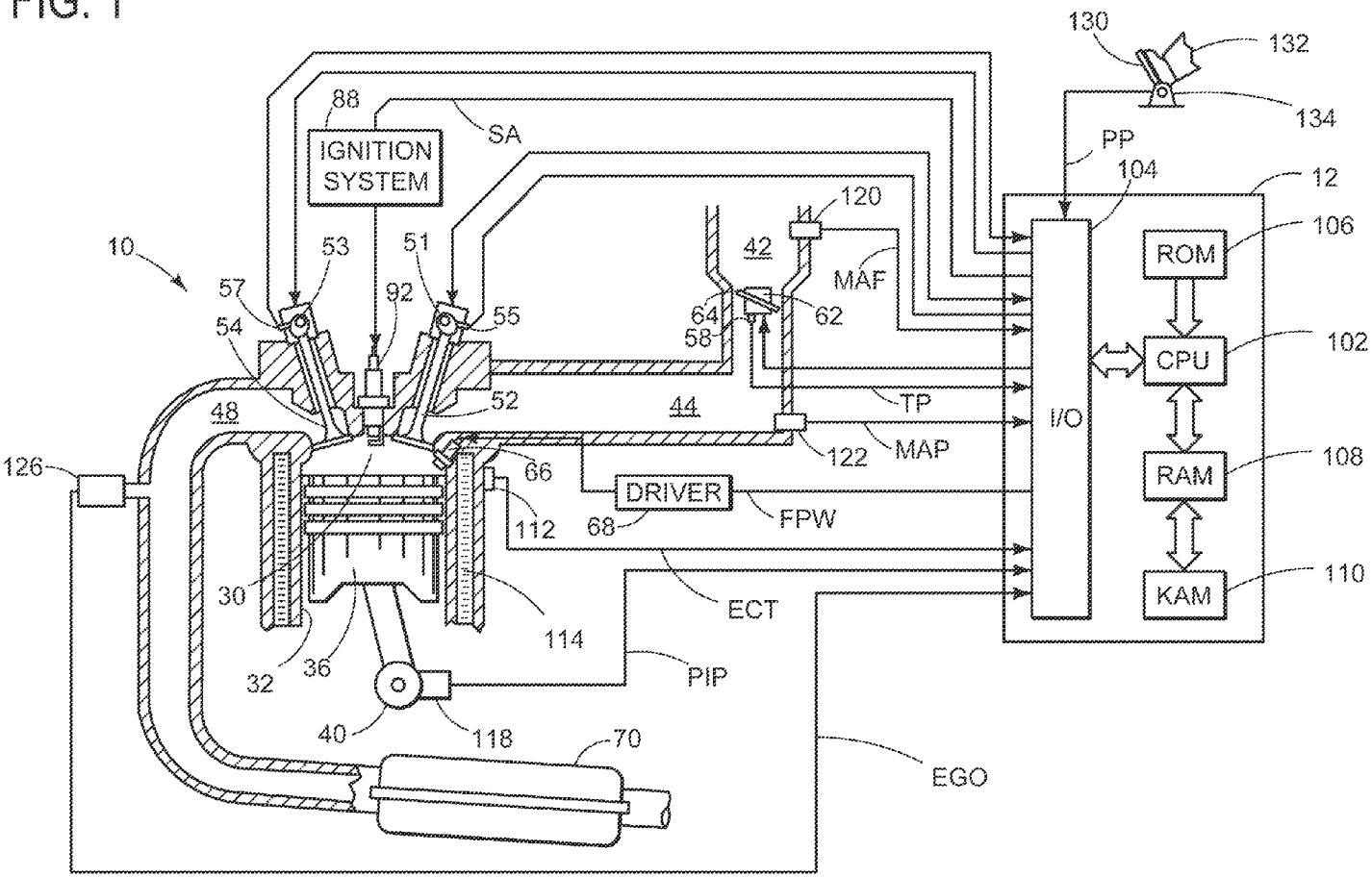
FIG. 1 shows a schematic depiction of an internal combustion engine.

An engine cylinder head with an integrated exhaust manifold (IEM cylinder head) is described herein. The integrated exhaust manifold directs exhaust from a plurality of inlet ports to a common exhaust collector and exhaust outlet port. The IEM cylinder head includes a coolant core formed from a plurality of coolant passages in communication with a coolant inlet and a coolant outlet. The coolant passages may include a coolant jacket that surrounds (at least partially) the exhaust manifold and in particular the outlet port. The IEM cylinder head cooling system may be configured to flow coolant through passages in the cylinder head via pressure generated by a coolant pump. In this way, cooling via heat exchange may be provided to the IEM cylinder head via the coolant jacket. The exhaust collector and the exhaust port may normally experience higher temperatures due to the flow characteristics within the integrated exhaust manifold. Moreover, heat exchange between the coolant jacket wall and the engine exhaust gases may cool engine exhaust and provide thermal protection to downstream components, such a turbocharger and/or an emission control system, etc. In a case where the coolant pump is damaged or the cooling system loses at least some of the liquid coolant, the IEM cylinder head may increase in temperature and steam may accumulate in a top portion of the coolant core. Liquid coolant may lose contact with the coolant jacket wall at a location where steam is accumulated, and heat exchange may be reduced. Thus, locally high temperatures may occur, thus thermally degrading the IEM cylinder head. Further, exhaust gas temperatures may increase, thus degrading downstream components of the exhaust system.

To at least partially address such conditions, a degas port may be included in an upper wall of the IEM cylinder head, such as at a dome in the vertical-most position of the coolant passages in the IEM cylinder head. The degas port may be fluidically coupled to the coolant core through the upper wall of the IEM cylinder head and the coolant jacket. The degas port may permit release of accumulated steam from the coolant chamber and generate a convective current, and thus liquid coolant may maintain contact with the upper wall of the coolant jacket. In this way, thermal stress on the IEM cylinder head, the exhaust port, and over-temperature conditions of downstream components may be reduced.

Further, at a confluence location proximal to the exhaust collector and the exhaust port, the IEM cylinder head may include a temperature sensor in communication with a controller of the vehicle. The controller may identify conditions where the sensed temperature is greater than a threshold in order to provide such indications to the operator, and/or to adjust engine operating conditions to reduce exhaust gas temperature of combustion gasses. Thus, the above described features may decrease the likelihood of thermal degradation of the IEM cylinder head, the exhaust collector, the exhaust port, the cylinder block, and/or downstream components, thereby increasing the life of engine components.

Figure 2:
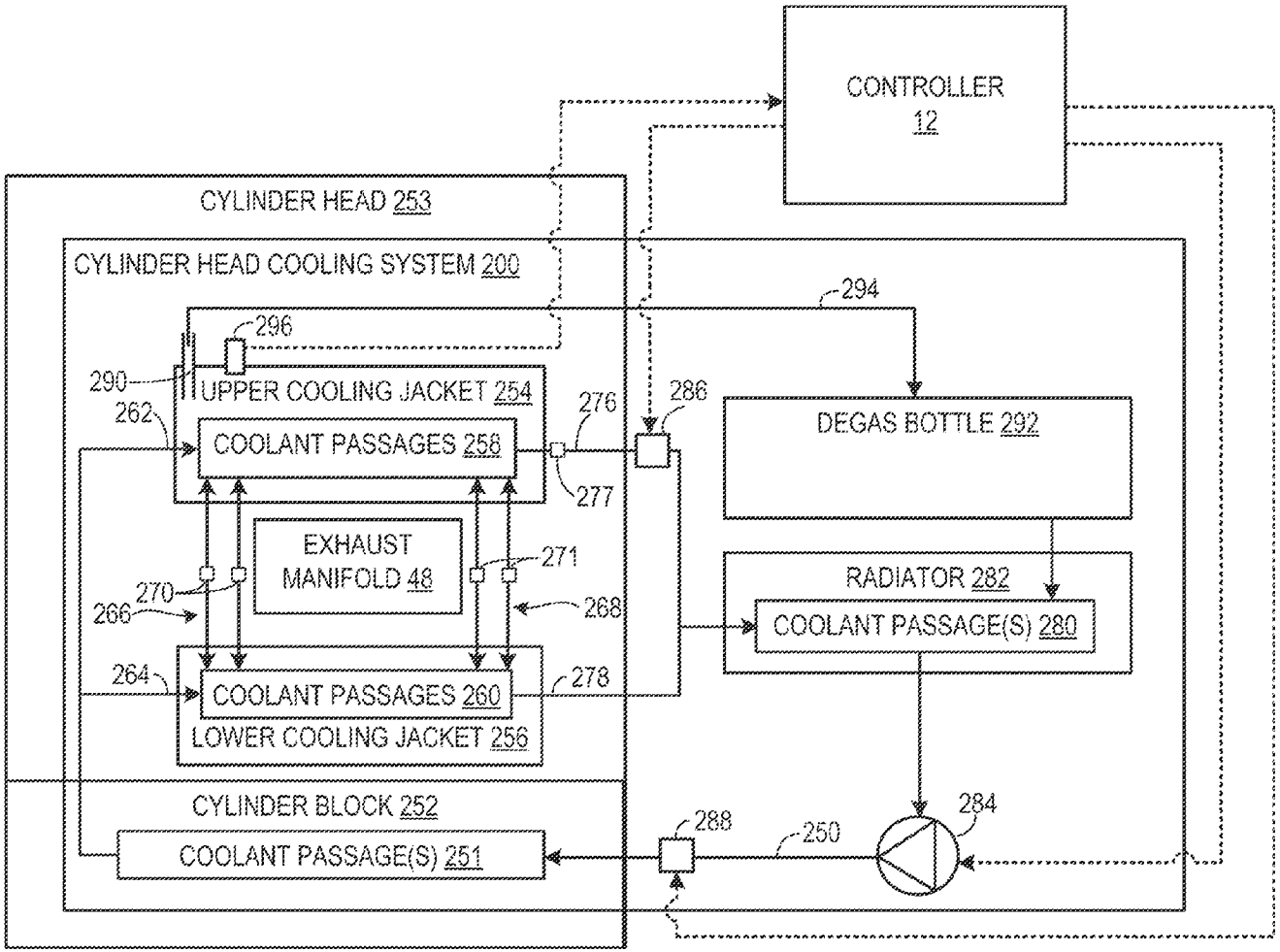
FIG. 2 shows a schematic depiction of an IEM cylinder head and associated cooling system that may be included in the internal combustion engine shown in FIG. 1.
Figure 3:
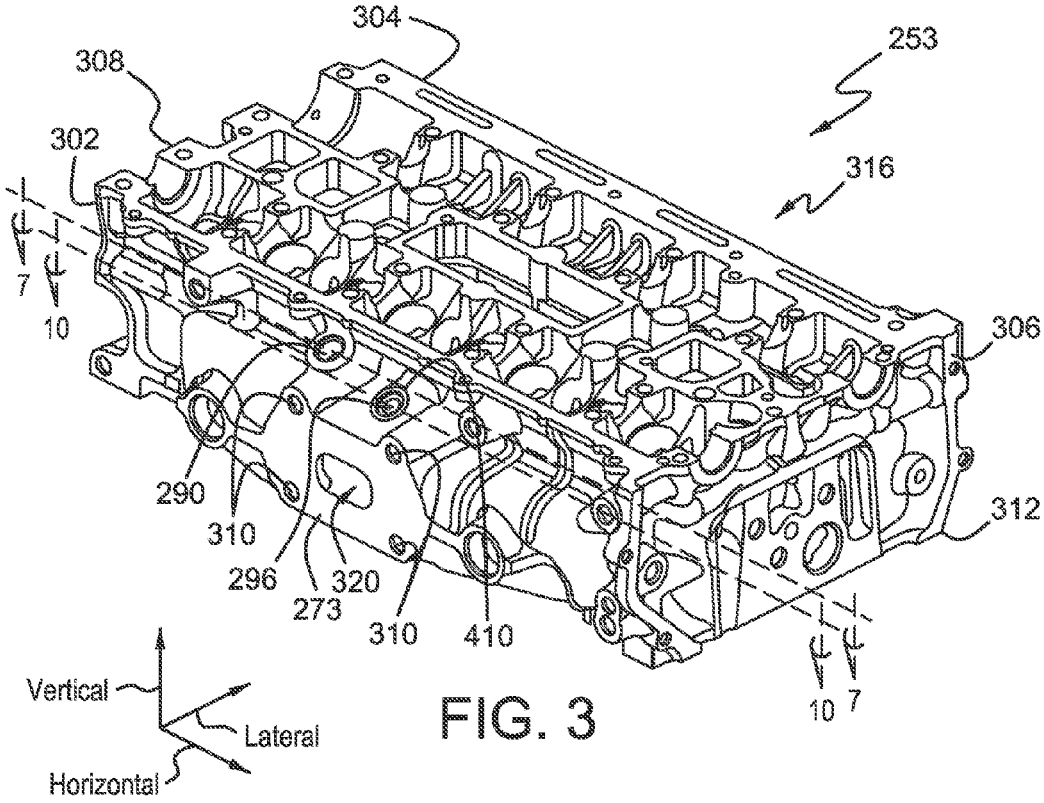
FIG. 3 shows perspective view of an exemplary integrated fuel cylinder head including a degas port.
Figure 4:
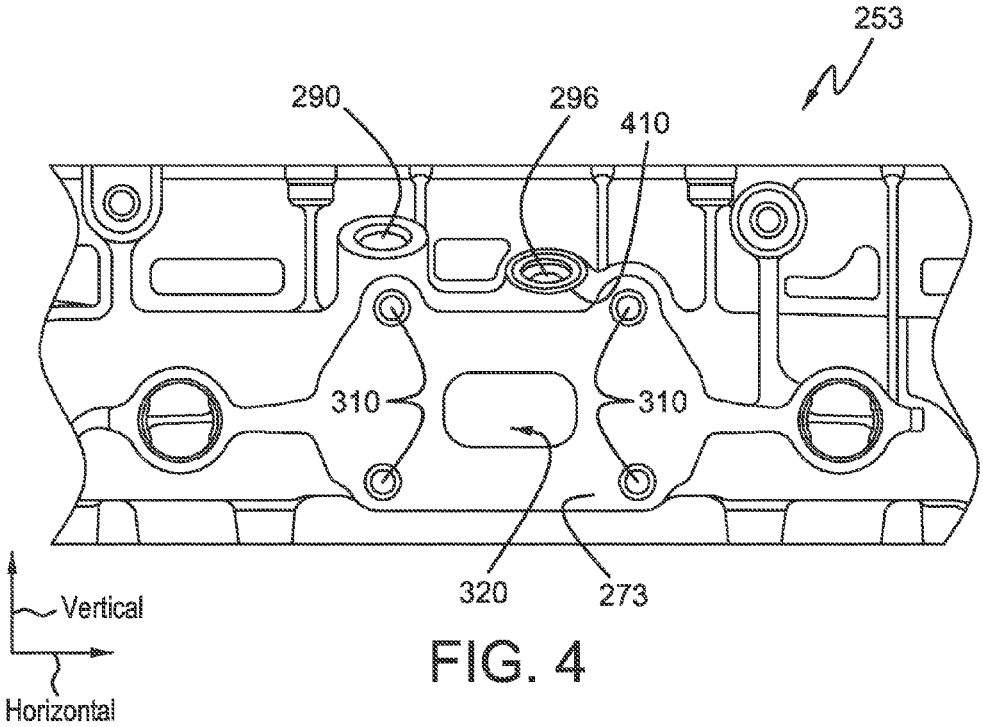
FIG. 4 shows a more detailed side view of the degas port, an exhaust port, and a temperature sensor of the cylinder head of FIG. 3
Figure 5:
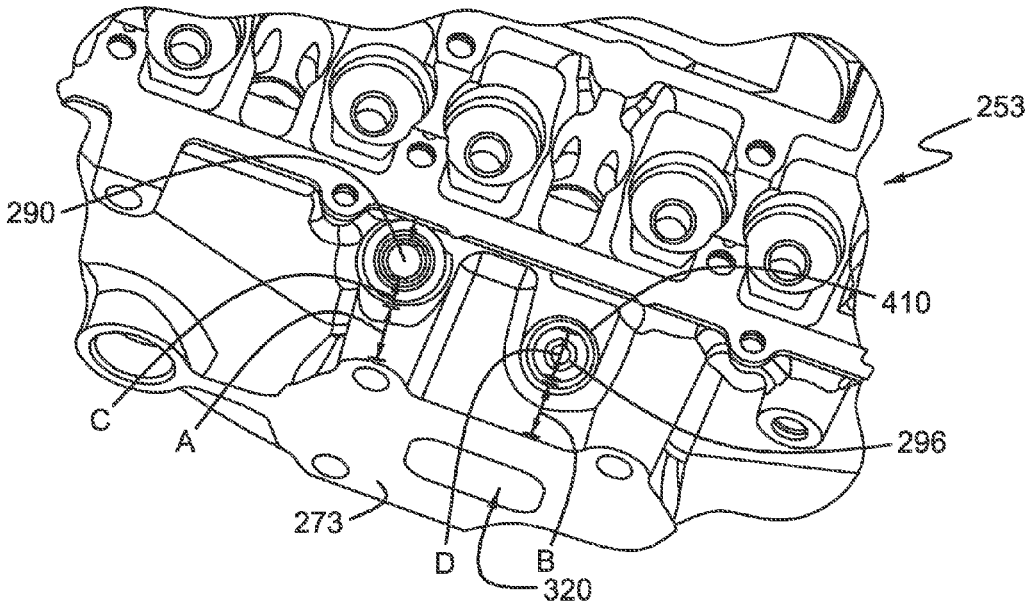
FIG. 5 shows a top side view of the degas port, the exhaust port, and the temperature sensor depicted in FIG. 4.
Figure 6:
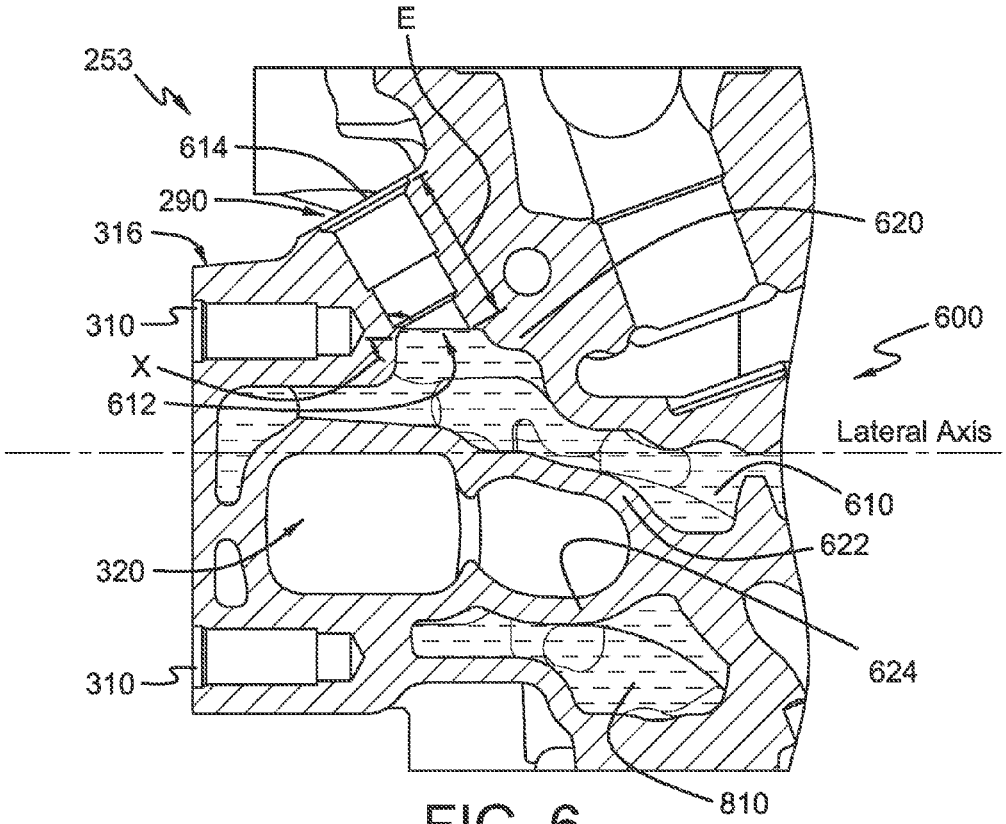
FIG. 6 shows a lateral cross-section of the degas port and exhaust port of FIG. 4, depicting a coolant core fluidically coupled to the degas port.
Figure 7:
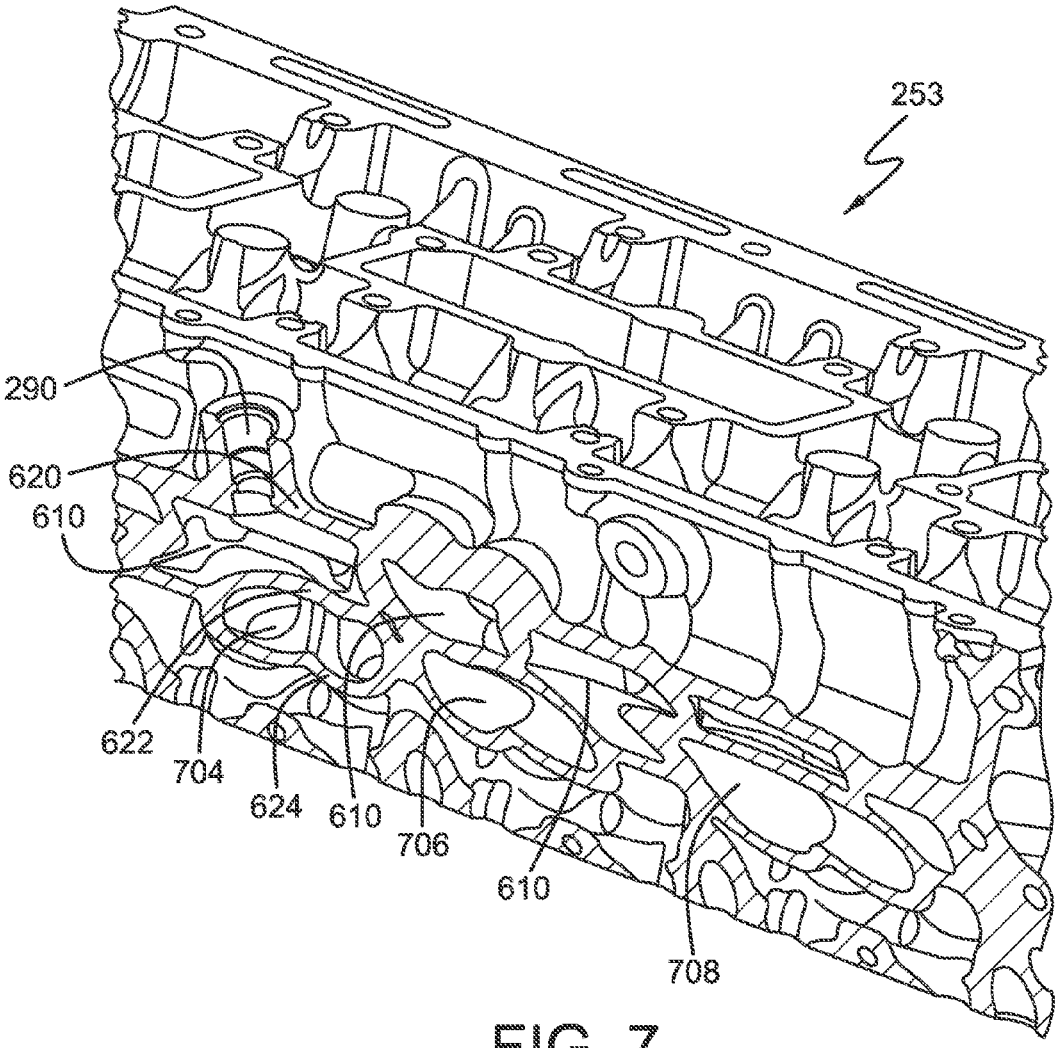
FIG. 7 shows a longitudinal cross-section of the cylinder head of FIG. 3, bisecting the degas port.
Figure 9:
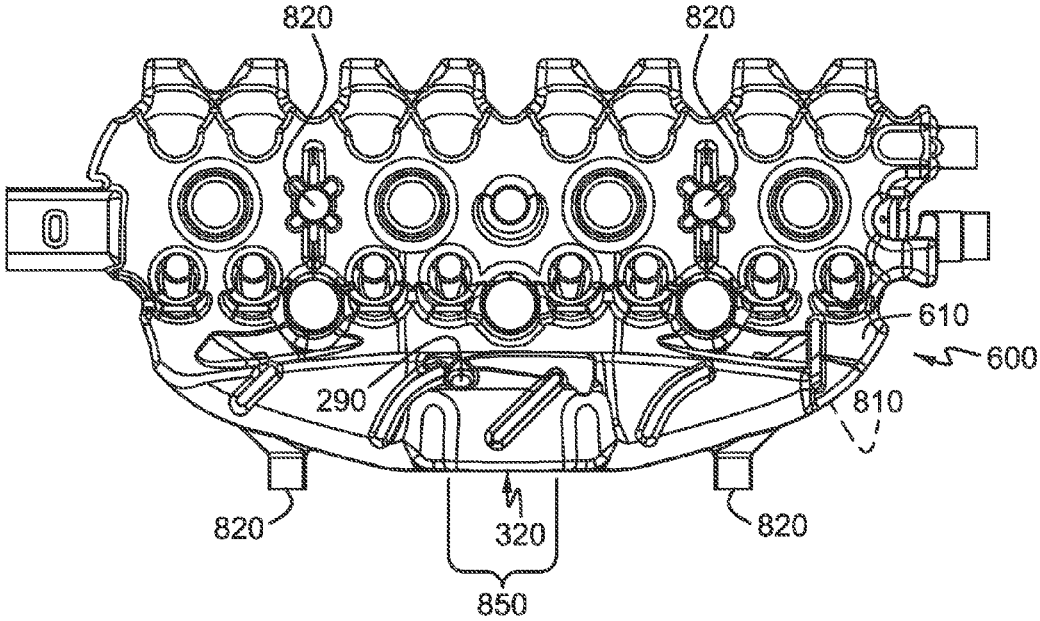
FIG. 9 shows a top side view of the coolant core of FIG. 8.
Figure 10:
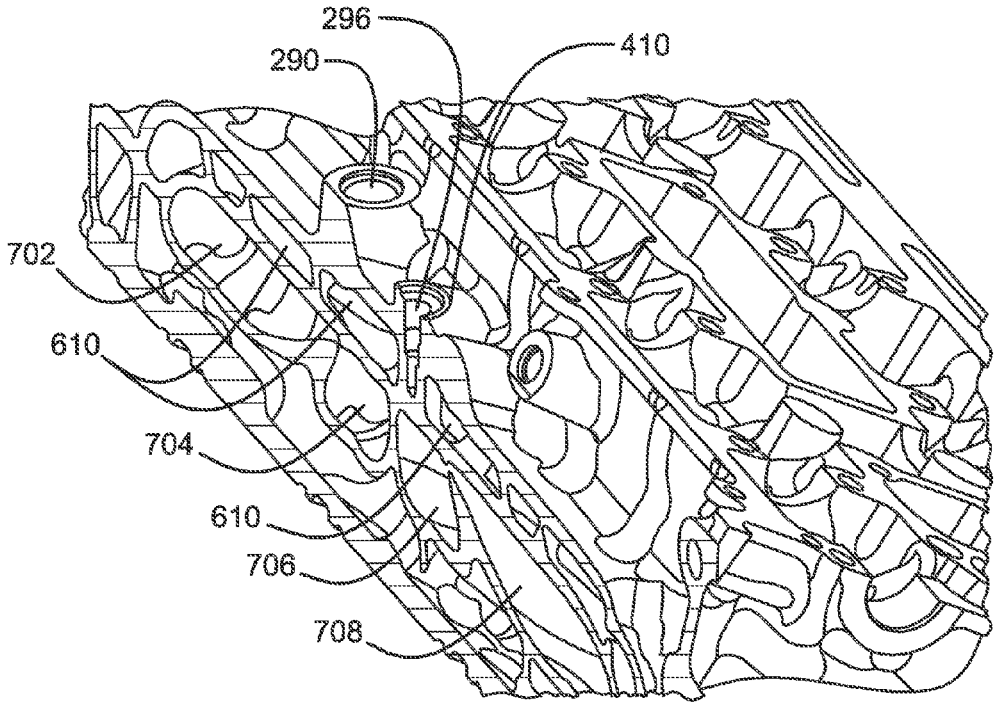
FIG. 10 shows a longitudinal cross-section of the integrated fuel cylinder head of FIG. 3, bisecting the temperature sensor.

The example IEM cylinder head described herein includes a vent, such as a degas port, in the upper coolant jacket, and may further include a temperature sensor in the upper coolant jacket. FIGS. 1 and 2 include schematic depictions of an example internal combustion engine and an example IEM cylinder head, respectively. As shown in FIG. 3, the IEM cylinder head includes an exhaust port, which is coupled to multiple exhaust runners (not shown) via an exhaust collector (shown in FIG. 6). FIG. 4 includes a more detailed view of the exhaust port of FIG. 3. As depicted in FIG. 4, the degas port and a temperature sensor are located in a region of the upper coolant jacket which is vertically above the exhaust port. The spatial orientation of the degas port and the temperature sensor relative to each other is shown in the top side view of FIG. 5. FIG. 6 is a cross section of the IEM cylinder head along the 6-6' axis of FIG. 3, showing the orientation of the degas port within the top wall of the IEM cylinder head and coupling of the degas port to an upper coolant core. The coolant core is shown in more detail in FIGS. 7 and 8. Further, a "hot spot" of the coolant core above the exhaust port is indicated in FIG. 7. FIGS. 9 and 10 show the location, orientation, and structure of the example temperature sensor.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

FIG. 2 shows a schematic depiction of a cylinder head cooling system 200 for an engine. It will be appreciated that the cooling system may be included in engine 10, shown in FIG. 1. The cooling system may be configured to remove heat from the engine. As discussed with greater detail herein, controller 12 may be configured to regulate the amount of heat removed from the engine via coolant circuit 250. In this way, the temperature of the engine may be regulated allowing the combustion efficiency to be increased as well as reducing thermal stress on the engine.

Cooling system 200 includes coolant circuit 250 traveling through one or more cylinder block coolant passage(s) 251 in a cylinder block 252. Water or another suitable coolant may be used as the working liquid in the coolant circuit. The cylinder block may include a portion of one or more combustion chambers. It will be appreciated that the coolant circuit may travel adjacent to the portions of the combustion chambers. In this way, excess heat generated during engine operation may be transferred to the coolant circuit. An IEM cylinder head 253 may be coupled to the cylinder block to form a cylinder assembly. When assembled, the cylinder assembly may include a plurality of combustion chambers. Combustion chamber 30 shown in FIG. 1 may be included in the plurality of combustion chambers.

The cylinder head cooling system further includes an upper coolant jacket 254 and a lower coolant jacket 256. It will be appreciated that the upper and lower coolant jackets are integrated into the cylinder head. The upper coolant jacket includes a plurality of coolant passages 258 comprising an upper coolant core. Likewise, the lower coolant jacket includes a plurality of coolant passages 260 comprising a lower coolant core. As shown, the upper coolant jacket includes a coolant inlet 262 and the lower coolant jacket includes a coolant inlet 264. However, it will be appreciated that the upper and/or lower coolant jackets may include a plurality of inlets in other embodiments. For example, the upper coolant jacket may include a single inlet and the lower coolant jacket may include a plurality of inlets. It will be appreciated that the inlets of the upper and lower coolant jackets may be coupled to a common coolant passages in the cylinder block in some embodiments. In this way, the upper and lower coolant jackets receive coolant via their respective inlets from a common source included in an engine block of an engine. However, in other embodiments the inlets of the upper and lower coolant jackets may be coupled to separate coolant passages in the cylinder block.

A first set of crossover coolant passages 266 may fluidly couple the upper coolant jacket 254 to the lower coolant jacket 256. Similarly, a second set of crossover coolant passages 268 may fluidly couple the upper coolant jacket to the lower coolant jacket.

Each crossover coolant passage included in the first set of crossover coolant passages may include a restriction 270. Likewise, each crossover coolant passage included in the second set of crossover coolant passages may include a restriction 271. Various characteristics (e.g., size, shape, etc.) of the restrictions may be tuned during construction of cylinder head 253. Therefore, the restrictions 270 included in the first set of crossover coolant passages may be different in size, shape, etc., than the restrictions 271 included in the second set of crossover coolant passages. In this way, the cylinder head may be tuned for a variety of engines, thereby increasing the cylinder head's applicability. Although two crossover coolant passages are depicted in both the first and second sets of crossover coolant passages, the number of crossover coolant passages included in the first set and second sets of crossover coolant passages may be altered in other embodiments.

The crossover coolant passages allow coolant to travel between the coolant jackets at various points between the inlets and the outlets of both the upper and lower coolant jackets. In this way, the coolant may travel in a complex flow pattern where coolant moves between the upper and lower jackets, in the middle of the jacket and at various other locations within the jacket. The mixed flow pattern reduces the temperature variability within the cylinder head during engine operation as well as increases the amount of heat energy that may be removed from the cylinder head, thereby improving engine performance. The exhaust manifold 48 is disposed between the upper and lower coolant jackets, 254 and 256, respectively. As such, walls of the exhaust manifold may be cooled while transporting heated engine exhaust, subsequently at least partially cooling the engine exhaust.

A coolant pump 284 may also be included in the coolant circuit. A thermostat 286 may be positioned at the outlet 276 of the upper coolant jacket. A thermostat 288 may also be positioned at the inlet of the one or more coolant passage(s) 251 of the cylinder block 252. Additional thermostats may be positioned at other locations within the coolant circuit in other embodiments, such as at the inlet or outlet of the one or more coolant passage(s) in the radiator, the inlet of the upper coolant jacket, etc. The thermostats may be used to regulate the amount of fluid flowing through the coolant circuit based on the temperature. In some examples, the thermostats may be controlled via controller 12. However in other examples, the thermostats may be passively operated.

It will be appreciated that controller 12 may regulate the amount of head pressure provided by coolant pump 284 to adjust the flow-rate of the coolant through the circuit and therefore the amount of heat removed from the engine. Furthermore, in some examples, controller 12 may be configured to dynamically adjust the amount of coolant flow through the upper coolant jacket via thermostat 286. Specifically, the flow-rate of the coolant through the upper coolant jacket may be decreased when the engine temperature is below a threshold value. In this way, the duration of engine warm-up during a cold start may be decreased, thereby increasing combustion efficiency and decreasing emissions.

Cooling of the exhaust manifold and engine exhaust via the coolant circuit and coolant jackets may protect the exhaust manifold and downstream engine components from thermal degradation, such as warping due to temperature gradients and/or degradation due to over-temperature conditions. In one particular example, liquid coolant is circulated via the coolant pump. In this way, coolant may be circulated around the exhaust manifold, enabling heat to be removed from the exhaust manifold. Therefore, thermal stresses on the cylinder head exhaust manifold, as well as neighboring components, may be reduced, thereby increasing component longevity. The radiator enables heat to be transferred from the coolant circuit to the surrounding air. In this way, heat may be removed from the coolant circuit.

However, problems may arise in the cooling system. In one example, if the coolant pump degrades and/or if loss of liquid coolant occurs, steam may accumulate at a top-most portion of the coolant core, forming a gas pocket against an upper wall of the coolant jacket. In this example, the liquid coolant may lose contact with the upper coolant jacket at the location of the gas pocket, and thus heat exchange and cooling of the coolant jacket may be reduced in this location. In one specific example, the gas pocket may form in the coolant core at a top-most location (e.g., vertically highest location of the core) that is proximal to an exhaust outlet or exhaust port. As heated engine exhaust converges at this location, the exhaust port may be subjected to high heat during selected operating conditions of the vehicle. As described above, under normal operating conditions, heat exchange with the liquid coolant through the upper coolant jacket wall relieves the high temperatures and prevents damage to engine components. If the gas pocket is present at this location, high temperatures may occur due to reduced heat transfer, and thus thermal degradation may occur.

In order to at least partially reduce such degradation, the cooling system 200 includes a degas port 290 in the upper coolant jacket 254. Degas port 290 is located in a top surface of upper coolant jacket 254 in a region that is adjacent a vertically top-most portion of the upper jacket, and that is in fluid communication with the coolant chamber. An outlet of the degas port is coupled to a degas line 294, which is further coupled to a degas bottle 292. The degas bottle may include a pressure relief valve, which opens to relieve pressure when a pressure in the degas bottle 292 is greater than a threshold. In one example, the pressure relief valve may passively open when the pressure of the degas bottle is greater than 16 psi. In an alternate embodiment, the degas bottle may include a pressure sensor in communication with the controller, and the degas valve may be operated by the controller. Degas bottle 292 is further coupled to coolant passage 280 of the radiator 282, such that liquid reductant may be returned to coolant circuit 250. In alternate embodiments, the degas bottle may return liquid reductant at a different location of coolant circuit 250, such as the water pump or cylinder block. Further, the upper coolant jacket 254 may also include a temperature sensor 296.

Thus, in a condition where the coolant circuit becomes overheated and steam accumulates at a top portion of the upper coolant jacket, the degas port may direct the steam to the degas bottle, while liquid coolant remains in the coolant chamber and a convective current is generated. As such, heat exchange between the coolant and the coolant jacket wall, and heat exchange between the coolant jacket wall and the exhaust gas may continue, even if the coolant system degrades due to coolant loss or reduced coolant flow. In one specific embodiment, the degas port is located in a top wall of the cylinder head and an upper wall of the upper coolant jacket at a location which is proximal to a common exhaust collector and exhaust port. The coolant passage degas port is discussed in greater detail herein with regard to FIGS. 3-8. It will be appreciated that the systems and components in FIG. 2 are schematically depicted and not meant to depict the relative location of the components.

FIG. 3 shows a perspective view of an example cylinder head 253. The cylinder head 253 is shown in an orientation in which the cylinder head is mounted to an engine in a vehicle, when the vehicle is on a driving surface, such as a road. The cylinder head may be configured to attach to a cylinder block (not shown) which defines one or more combustion chambers having a piston reciprocally moving therein as described above with regard to FIG. 1, for example. The cylinder head may be cast from a suitable material such as aluminum. Other components of an assembled cylinder head have been omitted. The omitted components include a camshafts, camshaft covers, intake and exhaust valves, spark plugs, etc.

As shown, IEM cylinder head 253 includes four perimeter walls. The walls include a first and a second side wall, 302 and 304 respectively. The four perimeter walls may further include a front end wall 306 and a rear end wall 308. A bottom wall 312 may be configured to couple to the cylinder head (not shown) thereby forming the engine combustion chambers, as previously discussed. A top wall 316 of the cylinder head further includes the degas port 290 including a valve configured to remove gas from the upper coolant jacket. More detailed views of the degas port are shown in FIGS. 4 and 5.

Cylinder head 253 includes exhaust port 320 to which a plurality of exhaust runners (not shown) are coupled. The exhaust runners may be coupled to the exhaust valves of each combustion chamber (not shown). In this way, the exhaust manifold and exhaust runners may be integrated into the cylinder head casting. The integrated exhaust runners have a number of benefits, such as reducing the number of parts within the engine thereby reducing cost throughout the engine's development cycle. Furthermore, inventory and assembly cost may also be reduced when an integrated exhaust manifold is utilized.

The cylinder head further includes exhaust manifold flange 273 surrounding the exhaust port 320. The flange includes bolt bosses 310 or other suitable attachment apparatuses configured to attach to a downstream exhaust component, such as an exhaust conduit or an inlet of a turbine included in a turbocharger. In this way, the turbocharger (not shown) may be mounted directly to the cylinder head reducing losses within the engine. The turbocharger may include an exhaust driven turbine coupled to a compressor via a drive shaft. The compressor may be configured to increase the pressure in the intake manifold.

FIG. 4 shows a more detailed view of the exhaust port 320 and the degas port 290. The degas port is positioned in an area adjoining an upper surface of the upper coolant jacket. In some examples, the degas port may be positioned at a crest (e.g., substantially highest vertical point) in the upper coolant jacket. As this location of the upper coolant jacket is proximal to the exhaust manifold, it may be a region that experiences higher temperatures during operation of the vehicle, and is a location where steam may accumulate. However in other embodiments, the degas port may be positioned in another suitable location, such as in the lower water jacket of a split water jacket design.

The degas port may decrease the amount of gas (e.g., air and/or water vapor) in both the upper and lower coolant jacket, thereby allowing liquid coolant to be drawn to the coolant jacket walls and generating a current of liquid coolant flowing through the coolant circuit. The venting of gas may allow for the liquid coolant to maintain contact with the coolant jacket walls and provide cooling to the coolant jacket walls via heat exchange. Moreover, the coolant walls may cool hot exhaust gas passing through the exhaust port 320, and at least partially reduce degradation to downstream components, such as a turbocharger. Thus, the operating efficiency of the upper and lower coolant jackets may be increased in a condition where steam may otherwise accumulate in the coolant core.

As shown in FIG. 4, a temperature sensor 296 is located proximal to the degas port 290. The temperature sensor extends through a hole 410 in the upper coolant jacket above the exhaust port 320. Thus, the temperature sensor may measure a temperature in a "hot zone" of the integrated cylinder head. As depicted in FIG. 2, the temperature sensor 296 sends a temperature signal the controller 12. The controller may use this temperature data to infer operating conditions and/or performance of the cooling system, such as loss of coolant, inoperable pump, and/or a system blockage. The controller may then send a signal to the driver giving early indication of the presence of a cooling system degradation if the temperature is greater than a threshold. Alternatively, or additionally, the controller may adjust engine operation, such as fuel injection amount or spark timing, to reduce exhaust gas temperature.

FIG. 5 shows a top side view of the detailed view shown in FIG. 4. FIG. 5 shows that the degas port 290 is located a distance A from the external surface of the flange 273, and the temperature sensor 296 is located a distance B from the external surface of the flange. In the present embodiment, the distance A is greater than the distance B, such that the temperature sensor is closer to the flange than the degas port. In alternate embodiments the distance B may be greater than the distance A, or the distances A and B may be substantially equal. In the alternate embodiment where the distance B is greater than the distance A, the degas port is closer to the flange than the temperature sensor. In the alternate embodiment where the distances A and B are equal, the degas port and the temperature sensor are equidistant from the flange.

The location for degas port placement may be subject to physical design and manufacturing constraints and optimization of the coolant flow, such that the coolant with the highest volume of entrained air vapor is directed closest to the degas port. As such, the degas port may be located in the highest water jacket area in the most rearward spot to use coolant flow to flush the entrapped are to the port opening. The temperature sensor placement may be as close as possible to the highest exhaust port location, which, in the present example, is where the hottest metal is located as well. This high spot may be where the metal is first exposed in the event of coolant loss. The degas location may be separate from the temp sensor to avoid interaction of the degas and temp sensor operation. Further, the degas may be positioned down stream of the metal sensor to avoid false readings. This would also be useful if the fail safe monitoring system incorporates a post shut down electric coolant pump, commonly called a "run on pump".

FIG. 6 depicts a cross section of the IEM cylinder head 253 along the 6-6' axis if FIG. 3 showing the location of the exhaust port 320, the degas port 290, an exhaust collector 630, and a coolant core 600 comprising coolant passages. Specifically, an upper core 610 of the coolant core 600 and the top wall 316 of the cylinder head 253 are shown. The degas port 290 is located above the exhaust collector 630 within the top wall 316, and the upper core 610 is disposed between the degas port 290 and the exhaust collector 630. More specifically, the degas port 290 is disposed within and passes through the top wall 316 of the integrated cylinder head 253, which is also a top wall of the coolant jacket. Thus, the degas port 290 is in fluid communication with the upper core 610 at a bottom end 612 of the degas port. The bottom end 612 is located in the top most region of a dome 632 of the upper core 610. Due to the lighter density of air/gas relative to the liquid coolant, the top most region of the upper core is where a gas pocket is likely to form under overheat conditions. An opposing, top end 614 of the degas port 290 is coupled to the degas line, which is further coupled to the degas bottle (schematically depicted in FIG. 2).

In the present embodiment, the degas port 290 is generally disposed vertically in the top wall 316. More specifically, the degas port 290 is angled outward from a center of the cylinder head at an angle X relative to the lateral axis of the integrated cylinder head 253. In one specific example, the angle X is 60 degrees. In alternate embodiments the degas port may be angled inward or may be parallel to a vertical axis of the cylinder head.

FIG. 7 shows a cross section of IEM cylinder head 253 along the 7-7 axis depicted in FIG. 3. The cross sectional view shows a second exhaust runner passage 704, a third exhaust runner passage 706, and a fourth exhaust runner passage 708. Each of the exhaust runner passages is coupled to a cylinder exhaust valve (schematically depicted in FIG. 1) at one end and the exhaust collector at an opposing end. As shown in FIG. 7, the degas valve 290 is located directly above the second exhaust runner passage 704.

Figure 8:
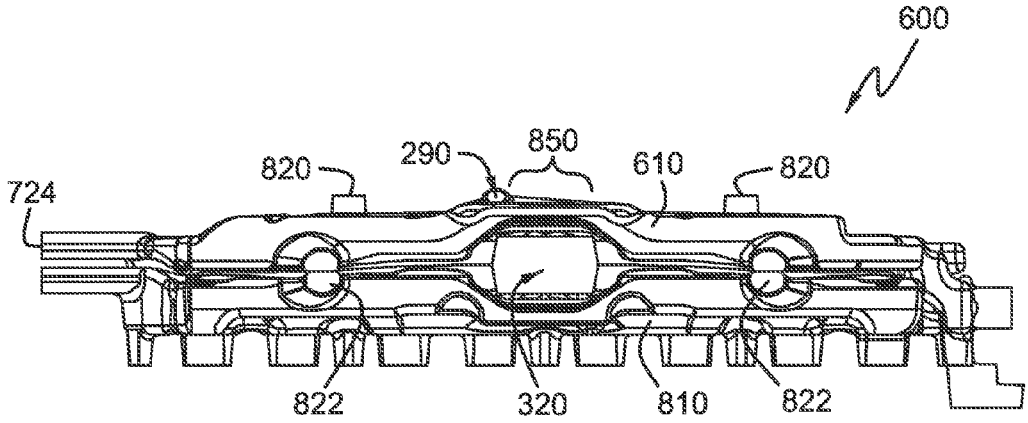
FIG. 8 shows a front view of a coolant core of the integrated fuel cylinder head of FIG. 3.

FIG. 8 shows the coolant core 600 including the upper core 610 and a lower core 810. The coolant core 600 may be formed by casting cores that are positioned as shown and placed together into an exterior mold during a casting process. Metal poured into the mold may then take the shape of the molds, hardening and forming cylinder head 253.

As shown, vertically aligned protrusions 820 included in both the upper and lower core may define the first set of crossover coolant passages 266. It will be appreciated that the crossover coolant passages may be vertically orientated relative to piston motion. The laterally aligned extensions 822 in both the upper and lower core may define the second set of crossover coolant passages 268. It will be appreciated that horizontally aligned extension 824 may define outlet 276 of the upper coolant jacket including restriction 277.

The upper and lower coolant jackets define a plurality of coolant passages, as previously discussed. Furthermore, the exhaust port 320 defines an opening to the exhaust manifold including a plurality of exhaust runners (not shown) fluidly coupled to the exhaust port. Thus, engine exhaust from the runners travels through the exhaust port during operation of the engine. As such, a temperature of the coolant core and the coolant jacket may increase at a region 750, which is proximate to the exhaust port and above the exhaust port. Thus, the region 750 may be a "hot zone" of the cylinder head. Further, as the region 750 is at a top of the coolant core 600 gases, such as air and/or steam, may accumulate at this region of the coolant core, particularly if the coolant pump is damaged and/or coolant loss occurs. As depicted in FIG. 9, in the present embodiment, the degas port 290 is located forward (toward a front end of the vehicle) and inward (toward a center of the cylinder head) of the exhaust port. In alternate embodiments, the degas port may be located at a rear side of the exhaust port or directly above the exhaust port. Further, in alternate embodiments, the cylinder head may include more than one degas port.

In addition to the degas port 290, the cylinder head may include the temperature sensor 296 in the region 750. The temperature sensor is depicted in FIGS. 2-5, 10, and 11. FIG. 10 shows a cross section of the cylinder head 235 along a longitudinal axis of the cylinder head (axis 10-10 of FIG. 3) which bisects the temperature sensor 296. In the present embodiment, the temperature sensor has a length with a distance F. In one specific example, the distance F is 29.1 mm. As described above, in the present embodiment, the temperature sensor 296 is positioned inward (toward a center of the cylinder head) from the flange 273 (shown in FIG. 5), and is directly above the exhaust passage 706. More specifically, the temperature sensor 296 is rearward of a longitudinal center of the exhaust port 320 and the exhaust collector 630. In alternate embodiments, the temperature sensor may be at a different location proximal to the exhaust port and/or the cylinder head may include more than one temperature sensor.

Figure 11:
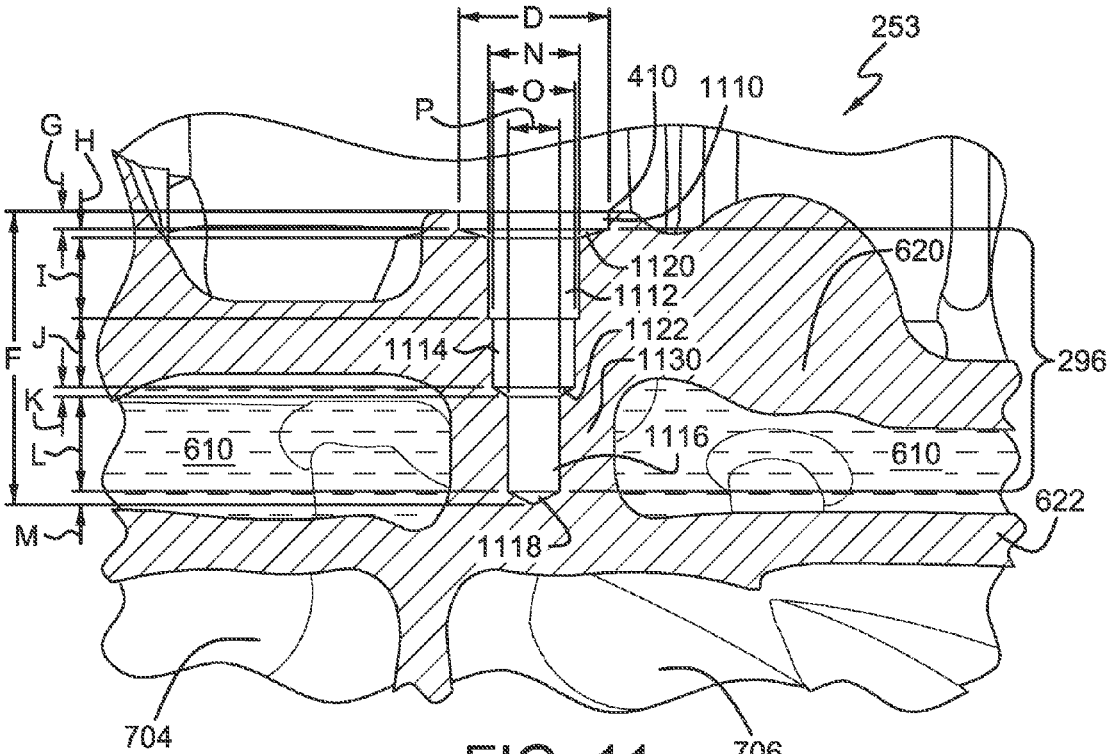
FIG. 11 shows a detailed view of the temperature sensor and surrounding components.

FIG. 11 includes a more detailed view of the temperature sensor 296 and its surrounding components. In the present embodiment, the temperature sensor includes consecutively narrower portions 1110, 1112, 1114, and 1116. Portion 1110 is a top, largest portion of the temperature sensor and is confluent with a top surface of wall 620. The temperature sensor machined hole may be narrower at the tip of the sensor to minimize the impact of coolant contact and flow reduction caused by the size of the metal boss used to mount the sensor.

The temperature sensor 296 is disposed within a vertical wall 1030 of the cylinder head 253. Vertical wall 1030 extends between passages of the upper core 610, and thus the temperature sensor 296 is encompassed by the upper core 610. For example, the temperature sensor is encompassed by the upper core because sides of the vertical wall wherein the temperature sensor is disposed are in contact with liquid coolant within the passages of the upper core. In an alternate example, the temperature sensor may be encompassed by the coolant core by being disposed within the coolant core and being in direct contact with liquid coolant. A conical tip end 1118 is proximate to an upper wall of the exhaust collector 630 and the region 750 of the coolant core 600. The conical tip end 1118 is a distance G from the top wall of the third exhaust runner passage 706. In one example, the distance G is 4.5 mm. The temperature sensor may provide a temperature measurement of the cylinder head within the region 750, at a location proximal to the exhaust face. As depicted in FIG. 2, the temperature sensor 296 sends a temperature signal to the controller 12.

The above described example cylinder head includes an integrated exhaust manifold. During operation of a vehicle including the cylinder head, the cylinder head may experience higher temperatures due to the flow characteristics within the integrated exhaust manifold. The cylinder head cooling system is configured to flow coolant through passages in the cylinder head to cool an IEM cylinder head. A degas port is disposed vertically in a top wall of the cylinder head, and is angled outward from a center of the cylinder head. The degas port is in fluid communication with an upper coolant core at a top most region of the upper coolant core. The degas port may allow release of accumulated steam from the coolant core, thus allowing liquid coolant to maintain contact with an upper coolant jacket wall. In this way, thermal stresses on the cylinder head walls, the exhaust port, and components downstream of the integrated exhaust manifold may be reduced. Further, the cylinder head may include a temperature sensor within a wall of the coolant jacket that is proximal to the exhaust port and encompassed by the passages of the upper coolant core. In a condition where the temperature in the region near the exhaust port is greater than a threshold, a warning signal may be sent to a driver to stop operation of the vehicle. Thus, the above described features may decrease the likelihood of thermal degradation of the exhaust collector, the exhaust port, the cylinder block, or neighboring components, such as a turbocharger, thereby increasing the components longevity.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine cooling system, comprising:

a cylinder head including an integrated exhaust manifold that directs exhaust gases to an exhaust port;

a coolant passage that includes an upper coolant jacket and a lower coolant jacket, the coolant passage surrounding the exhaust manifold and having an upper wall vertically above the exhaust port;

a degas port with a horizontally-positioned inlet and an outlet above the inlet, the degas port positioned in a top-most region of a dome above a collector within the upper wall and fluidically coupled to the coolant passage; and a temperature sensor positioned in the upper wall of the coolant passage proximate to a confluence of a plurality of exhaust as ports in the exhaust manifold, the temperature sensor further encompassed within a vertical wall of the cylinder head proximate to an upper wall of the collector, the degas port being mounted in the cylinder head a first distance from a flange of a single exhaust exit port along a lateral axis of the cylinder head when the system is mounted in a passenger vehicle, and the temperature sensor being mounted a second distance from the flange of the single exhaust port along the lateral axis of the cylinder head when the system is mounted in the passenger vehicle, the second distance less than the first distance.

2. The engine cooling system of claim 1, wherein the degas port is fluidically coupled to the upper coolant jacket.

3. The engine cooling system of claim 2, wherein the degas port is disposed in an upper wall of the upper coolant jacket, the degas port leading at least partially vertically away from the upper coolant jacket to vent the coolant jacket.

4. The engine cooling system of claim 3, wherein the degas port is disposed at a vertical angle within the upper wall of the upper coolant jacket.

5. The engine cooling system of claim 4, wherein the vertical angle of the degas port is 60 degrees relative to a lateral axis of the cylinder head.

6. The engine cooling system of claim 1, wherein the degas port leads fluidically to a degas bottle to vent the coolant passage.

7. The engine cooling system of claim 6, wherein the degas bottle is fluidically coupled to a radiator.

8. The engine cooling system of claim 2, wherein the temperature sensor is encompassed by the coolant passage, and is positioned vertically above an exhaust manifold confluence.

9. The engine cooling system of claim 2, wherein the temperature sensor is configured to send a temperature signal to a controller, the controller configured to send a warning signal to a driver when the temperature is above a threshold.

10. An engine system comprising:

a cylinder head including an integrated exhaust manifold that directs a plurality of exhaust gas inlet ports to an exhaust collector and a single exhaust exit port;

an upper coolant jacket with a degas port at a top of a dome above the exhaust collector and a lower coolant jacket below the exhaust collector, the upper and lower coolant jackets being fluidically coupled and surrounding the exhaust manifold;

a liquid within the coolant jackets maintaining contact with an upper wall located vertically above the single exhaust exit port; and a temperature sensor positioned above the exhaust collector and encompassed within a vertical wall of the cylinder head such that the temperature sensor is positioned between the upper and lower coolant jackets proximate to an upper wall of the exhaust collector, wherein the degas port is mounted in the cylinder head a first distance from a flange of the single exhaust exit port along a lateral axis of the cylinder head when the system is mounted in a passenger vehicle, and the temperature sensor is mounted a second distance from the flange of the single exhaust port along the lateral axis of the cylinder head when the system is mounted in the passenger vehicle, the second distance less than the first distance.

11. The system of claim 10 wherein the degas port is fluidically coupled between a degas bottle and an upper coolant core, the upper coolant core enclosed by the upper coolant jacket.

12. The system of claim 11 wherein the degas port leads from a highest portion of the upper coolant core with respect to a vertical axis when the system is mounted in a passenger vehicle.

13. The system of claim 10, wherein the temperature sensor is mounted rearward along a longitudinal axis of the cylinder head relative to the degas port and to a central lateral axis of the exhaust collector when the system is mounted in a passenger vehicle.

14. The system of claim 13, wherein the degas port is located forward along the longitudinal axis of the cylinder head relative to the central lateral axis of the exhaust collector.

15. The system of claim 10, wherein the degas port is disposed at a vertical angle within an upper wall of the upper coolant jacket.

16. An engine system comprising:

a cylinder head including an integrated exhaust manifold that directs a plurality of exhaust gas inlet ports to an exhaust collector and a single exhaust exit port;

an upper coolant jacket enclosing an upper coolant core and a lower coolant jacket enclosing a lower coolant core, the upper coolant jacket and the lower coolant jacket surrounding the exhaust manifold, the upper coolant jacket including a dome positioned above the exhaust collector at a vertical top most region of the upper coolant jacket when the system is mounted in a passenger vehicle;

a degas port with a horizontally-positioned inlet and an outlet above the inlet, the degas port positioned at a vertical top of the dome and disposed at a vertical angle within an upper wall of the upper coolant jacket, the degas port fluidically coupled between a degas bottle and the upper coolant core, wherein the degas port is located forward along a longitudinal axis of the cylinder head relative to a central lateral axis of the exhaust collector, and the degas port is mounted in the cylinder head a first distance from a flange of the single exhaust port along a lateral axis of the cylinder head; and a temperature sensor positioned above the exhaust collector and disposed vertically within a vertical wall, wherein the temperature sensor is encompassed by the vertical wall and positioned proximate an upper wall of the exhaust collector, and wherein the vertical wall is further encompassed by passages of the upper coolant jacket, wherein the temperature sensor is mounted rearward along the longitudinal axis of the cylinder head relative to the degas port and to the central lateral axis of the exhaust collector, and the temperature sensor is mounted a second distance from the flange of the single exhaust port along the lateral axis of the cylinder head, the second distance less than the first distance.

* * * * *